US009643424B2

(12) United States Patent
Ando

(10) Patent No.: US 9,643,424 B2
(45) Date of Patent: May 9, 2017

(54) PRINTING APPARATUS

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/069,485

(22) Filed: Mar. 14, 2016

(65) Prior Publication Data

US 2016/0288518 A1 Oct. 6, 2016

(30) Foreign Application Priority Data

Mar. 30, 2015 (JP) ..... 2015-068978

(51) Int. Cl.
*B41J 2/175* (2006.01)
*B41J 2/18* (2006.01)

(52) U.S. Cl.
CPC ..... *B41J 2/17566* (2013.01); *B41J 2/175* (2013.01); *B41J 2/17596* (2013.01); *B41J 2/18* (2013.01)

(58) Field of Classification Search
CPC .... B41J 2/17566; B41J 2/17596; B41J 2/175; B41J 2/18
See application file for complete search history.

(56) References Cited

U.S. PATENT DOCUMENTS

2012/0224007 A1 9/2012 Koike et al.
2014/0246510 A1* 9/2014 Albertin ..... B41J 2/175 239/11

FOREIGN PATENT DOCUMENTS

JP 2012-183695 A 9/2012

* cited by examiner

*Primary Examiner* — Bradley Thies
(74) *Attorney, Agent, or Firm* — Global IP Counselors, LLP

(57) ABSTRACT

A printing apparatus includes: an ink discharge head discharging UV ink; a sub-tank storing the UV ink; a supply pump sending the UV ink to the sub-tank from an ink cartridge; an ink circulation path having a forward circulation path through which the UV ink supplied to the ink discharge head from the sub-tank flows, and a backward circulation path through which the UV ink returning to the sub-tank from the ink discharge head flows; and a receptacle that has an opening opened upward and is provided inside the sub-tank. Here, a backward-path downstream-side end which is an end portion of the backward circulation path on the sub-tank side is positioned below the opening inside the receptacle and a forward-path upstream-side end which is an end portion of the forward circulation path on the sub-tank side is positioned below the receptacle inside the sub-tank.

9 Claims, 7 Drawing Sheets

PRINTING APPARATUS

BACKGROUND

1. Technical Field

The present invention relates to a printing apparatus that includes an ink circulation path having the ink discharge head.

2. Related Art

Recently, an ink jet printer, which includes a print head that discharges ink, a sub-tank that stores ink, a supply pump that supplies ink to a sub-tank from a main tank containing the ink, and a circulation path having a forward path through which the ink, which is supplied from the sub-tank to the print head, flows, and a backward path through which the ink, which returns to the sub-tank from the print head, flows, has been known (refer to JP-A-2012-183695).

The inventors have found the following problems.

In the printing apparatus such as an ink jet printer in the related art, a height difference between the nozzle surface of the ink discharge head and a level of the ink in the ink storage unit becomes a water head difference which has an influence on a back pressure (hereinafter, referred to as a "head back pressure") of the ink in the ink discharge head. In order to control fluctuation of the head back pressure, a level of the ink stored in the ink storage unit may be positioned within a predetermined height range. Therefore, it is preferable that a liquid sending unit supplies the ink from the ink container to an ink storage unit depending on an ink discharge amount from the ink discharge unit. However, the level of the ink in the ink storage unit becomes lower than a predetermined range, in some cases, such as when the ink is not properly supplied to the ink storage unit due to an abnormality in the liquid sending unit. In this case, since the height difference between the nozzle surface of the ink discharge head and the level of the ink in the ink storage unit, that is, the water head difference which has an influence on the head back pressure becomes greater, the head back pressure fluctuates.

SUMMARY

An advantage of some aspects of the invention is to provide a printing apparatus in which it is possible to suppress fluctuations of a head back pressure.

According to an aspect of the invention, there is provided a printing apparatus including: an ink discharge head that discharges ink; an ink storage unit that stores the ink; a liquid sending unit that sends the ink to the ink storage unit from an ink container containing the ink; an ink circulation path having a forward circulation path through which the ink, which is supplied to the ink discharge head from the ink storage unit, flows, and a backward circulation path through which the ink, which returns to the ink storage unit from the ink discharge head, flows; and a receptacle that has an opening opened upward and is provided inside the ink storage unit, in which an end portion of the backward circulation path on the ink storage unit side is positioned below the opening inside the receptacle and an end portion of the forward circulation path on the ink storage unit side is positioned below the receptacle inside the ink storage unit.

In this case, the end portion of the backward circulation path on the ink storage unit side is positioned below the opening inside the receptacle and the end portion of the forward circulation path on the ink storage unit side is positioned below the receptacle. Therefore, even in a case where the level of the ink in the ink storage unit becomes lower than the height position of the opening, the ink inside the receptacle is not reduced but the level of the ink in the receptacle is maintained to be equal to the height position of the opening. In a case where the level of the ink in the ink storage unit becomes lower than the height position of the opening, a height difference between the nozzle surface of the ink discharge head and the opening of the receptacle is hereby a water head difference which has an influence on the head back pressure. Accordingly, in a case where the level of the ink in the ink storage unit becomes lower than a predetermined height range due to an abnormality in the liquid sending unit, the head back pressure does not fluctuate because the water head difference which has an influence on the head back pressure is maintained to be a constant value (the height difference between the nozzle surface of the ink discharge head and the opening of the receptacle). Hence, in the printing apparatus, it is possible to control the fluctuation of the head back pressure.

In the printing apparatus, it is preferable that the apparatus further includes a control unit that controls the liquid sending unit such that the level of the ink in the ink storage unit is positioned in a range equal to or higher than the first level which is a position equal to the height position of the opening and equal to or lower than the second level which is a position higher than the height position of the opening by a predetermined length.

In this case, the level of the ink in the ink storage unit is positioned between the first level which is a position equal to the height position of the opening and the second level which is a position higher than the height position of the opening by a predetermined length. Here, in a case where the level of the ink in the ink storage unit is positioned at the second level, the water head difference which has an influence on the head back pressure becomes the smallest value; however, even in this case, the water head difference is a value smaller than the height difference between the nozzle surface of the ink discharge head and the opening of the receptacle, by a predetermined length. As described above, in a case where the level is lower than a predetermined height range of the ink in the ink storage unit due to the abnormality in the liquid sending unit, the value means the water head difference which has an influence on the head back pressure and changes only by the predetermined length at most. Accordingly, according to the configuration, it is possible to reduce a difference between the head back pressure obtained in a case where the liquid sending unit normally operates and the head back pressure obtained in a case where the liquid sending unit has an abnormality.

In the printing apparatus, it is preferable that the control unit controls the liquid sending unit such that the level of the ink in the ink storage unit is equal to the first level.

In this case, it is possible to eliminate the difference between the head back pressure obtained in the case where the liquid sending unit normally operates and the head back pressure obtained in the case where the liquid sending unit has an abnormality.

In the printing apparatus, it is preferable that the apparatus further includes: a control unit that controls the liquid sending unit such that the level of the ink in the ink storage unit becomes lower than the first level which is a position equal to the height position of the opening; and a check valve that is provided in the backward circulation path and blocks the ink from reversely flowing to the ink discharge head in the backward circulation path.

In this case, the control is performed such that the level of the ink in the ink storage unit becomes lower than the first level. Therefore, in the case where the liquid sending unit normally operates, the height difference between the nozzle surface of the ink discharge head and the opening of the receptacle becomes the water head difference which has an influence on the head back pressure. Accordingly, it is possible to eliminate the difference between the head back pressure obtained in the case where the liquid sending unit normally operates and the head back pressure obtained in the case where the liquid sending unit has an abnormality.

Further, in a case where the level of the ink in the ink storage unit becomes lower than the level of the ink in the receptacle and circulation of the ink in the ink circulation path is stopped, the reverse flowing of the ink in the ink circulation path is suppressed because the check valve is provided in the backward circulation path.

In the printing apparatus, it is preferable that the apparatus further includes a supply flow path through which the ink, which is supplied to the ink storage unit from the ink container, flows, and the control unit controls the liquid sending unit such that the level of the ink in the ink storage unit is positioned above the height position of the end portion of the supply flow path on the ink storage unit side.

In this case, the ink flows from the supply flow path to the ink storage unit at a position below the level of the ink in the ink storage unit. Therefore, the generation of the bubbles in the ink in the ink storage unit is suppressed when the ink flows into the ink storage unit.

In the printing apparatus, it is preferable that a height difference between the nozzle surface of the ink discharge head and the opening of the receptacle is a height difference causing a back pressure, with which no air infiltrates into the inside of the ink discharge head from a nozzle and no ink leaks from the nozzle of the ink discharge head, to be applied to the ink in the ink discharge head.

In this case, infiltration of the air from the nozzle into the inside of the ink discharge head is suppressed and the leakage of the ink from the nozzle of the ink discharge head is suppressed.

In the printing apparatus, it is preferable that the apparatus further includes an attachment member through which the receptacle is attached to the end portion of the backward circulation path on the ink storage unit side.

In this case, the receptacle is attached to the end portion of the backward circulation path on the ink storage unit side through the attachment member.

According to another aspect of the invention, there is provided a printing apparatus including: an ink discharge head that discharges ink; an ink storage unit that stores the ink; a liquid sending unit that sends the ink to the ink storage unit from an ink container containing the ink; an ink circulation path having a forward circulation path through which the ink, which is supplied to the ink discharge head from the ink storage unit, flows, and a backward circulation path through which the ink, which returns to the ink storage unit from the ink discharge head, flows; and a receptacle that has a first opening and a second opening positioned below the first opening, and that is provided in the ink storage unit, in which an end portion of the backward circulation path on the ink storage unit side is connected to the second opening and an end portion of the forward circulation path on the ink storage unit side is positioned below the receptacle inside the ink storage unit.

In this case, the end portion of the backward circulation path on the ink storage unit side is connected to the second opening which is a position below the first opening and the end portion of the forward circulation path on the ink storage unit side is positioned below the receptacle. Therefore, even in a case where the level of the ink in the ink storage unit is lower than the height position of the first opening, the ink inside the receptacle is not reduced but the level of the ink in the receptacle is maintained to be equal to the height position of the first opening. In a case where the level of the ink in the ink storage unit becomes lower than the height position of the first opening, a height difference between the nozzle surface of the ink discharge head and the first opening of the receptacle is hereby a water head difference which has an influence on the head back pressure. Accordingly, in a case where the level of the ink in the ink storage unit becomes lower than a predetermined height range due to an abnormality in the liquid sending unit, the head back pressure does not fluctuate because the water head difference which has an influence on the head back pressure is maintained to be a constant value (the height difference between the nozzle surface of the ink discharge head and the first opening of the receptacle). Hence, in the printing apparatus, it is possible to control the fluctuation of the head back pressure.

In the printing apparatus, it is preferable that the second opening is provided on the side surface of the receptacle, a joint communicating with the second opening is provided on the side surface of the receptacle, and the end portion of the backward circulation path on the ink storage unit side is fitted to the joint.

BRIEF DESCRIPTION OF THE DRAWINGS

Embodiments of the invention will now be described by way of example only with reference to the accompanying drawings, wherein like numbers reference like elements.

FIG. 3A is a perspective view; FIG. 3B is a top view; and FIG. 3C is a sectional view.

FIG. 4A is a view illustrating a state in which the supply pump normally operates; and FIG. 4B is a view illustrating a state in which the supply pump has an abnormality.

FIG. 5A is a view illustrating a state in which the supply pump normally operates; and FIG. 5B is a view illustrating a state in which the supply pump has an abnormality.

FIG. 7A is a front view; and FIG. 7B is a sectional view obtained when the receptacle and the backward circulation path are cut through.

DESCRIPTION OF EXEMPLARY EMBODIMENTS

Hereinafter, a printing apparatus 1 according to an embodiment of the invention will be described with reference to the accompanying drawings.

Figure 1:
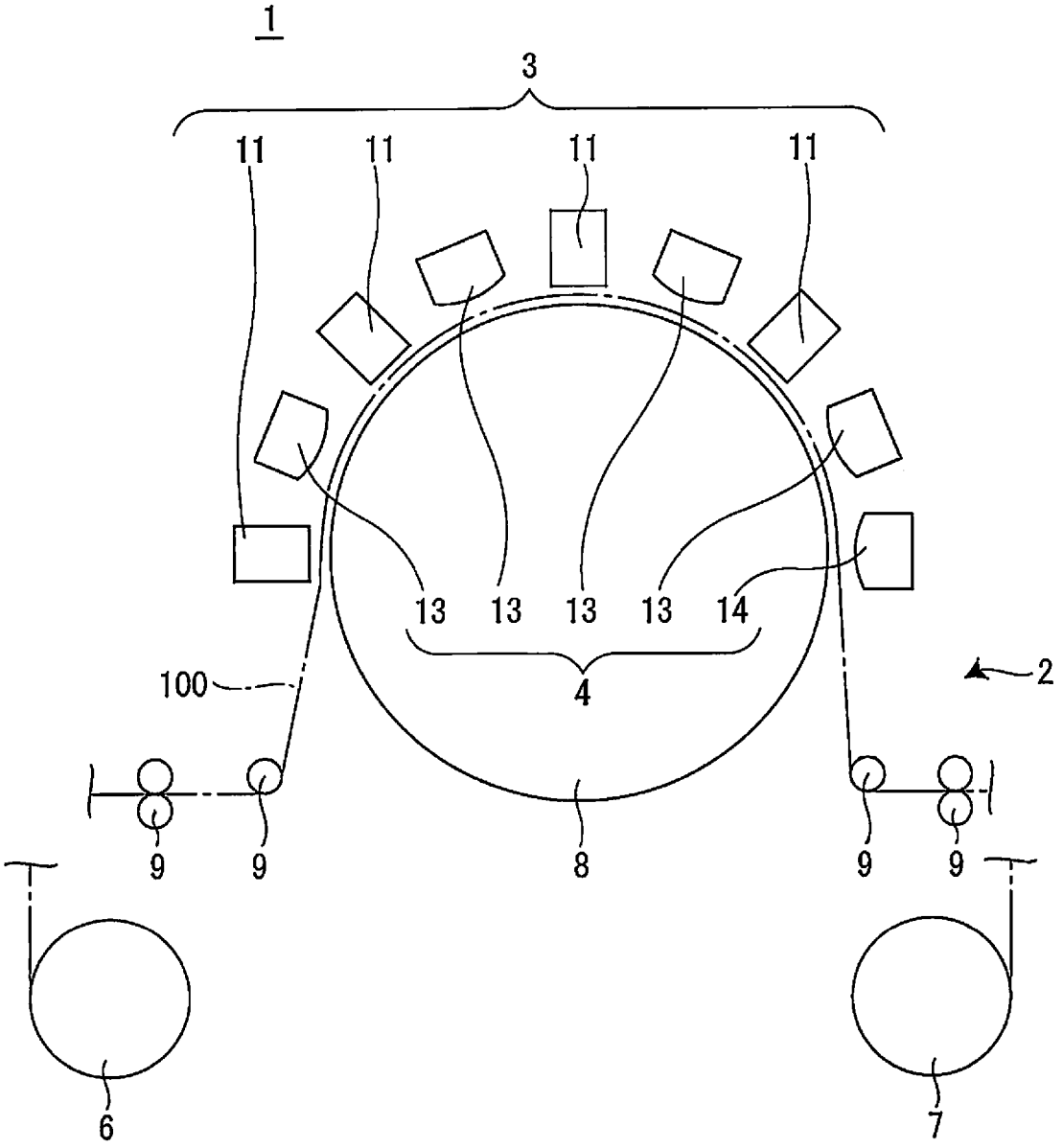
FIG. 1 is a view schematically illustrating a configuration of a printing apparatus according to an embodiment of the invention.

The entire configuration of the printing apparatus 1 will be described with reference to FIG. 1. The printing apparatus 1 performs printing to a set printing medium 100 by discharging ultraviolet curing ink (hereinafter, referred to as "UV ink"). The printing medium 100 is strip-shaped continuous paper. Further, there is no particular limitation on a material of the printing medium 100 and various media such as a paper medium or a film medium are used.

The printing apparatus 1 includes a feeding unit 2, an ink discharge section 3, and an irradiation unit 4. In addition, although not illustrated in FIG. 1, the printing apparatus 1 includes an ink supply unit 5 (refer to FIG. 2) which supplies the UV ink to the ink discharge section 3.

The feeding unit 2 feeds the printing medium 100 in a roll-to-roll method. The feeding unit 2 includes a supply reel 6, a winding reel 7, a rotating drum 8, and a plurality of rollers 9. The printing medium 100 supplied from the supply reel 6 is wound around the winding reel 7 via the rotating drum 8 and the plurality of rollers 9. The rotating drum 8 is a cylindrical drum which is rotatably supported by a support mechanism (not illustrated). When the printing medium 100 is fed along a circumferential surface of the rotating drum 8, the rotating drum 8 is driven to rotate due to frictional force between the circumferential surface and the printing medium 100. The rotating drum 8 functions as a platen with respect to the ink discharge section 3.

The ink discharge section 3 includes a plurality of head units 11. The plurality of head units 11 are arranged along the circumferential surface of the rotating drum 8. The plurality of head units 11 are in one-to-one correspondence to a plurality of types (for example, four colors of CMYK) of UV ink. Each of the head units 11 includes a plurality of ink discharge heads 12 (refer to FIG. 2) which discharge UV ink in an ink jet method. The head unit 11 discharges UV ink to the printing medium 100 supported on the circumferential surface of the rotating drum 8. A color image is hereby formed on the printing medium 100.

The irradiation unit 4 includes a plurality of pre-curing irradiators 13 and a main-curing irradiator 14. The plurality of pre-curing irradiators 13 are arranged along the circumferential surface of the rotating drum 8 to be alternately positioned with the plurality of head units 11. The pre-curing irradiator 13 is provided on the downstream side on a feeding route of the printing medium 100 with respect to the corresponding head unit 11. The pre-curing irradiator 13 irradiates, with ultraviolet, the printing medium 100 to which the UV ink is discharged. The UV ink is hereby temporarily or partially cured immediately after landing on the printing medium 100, and thus spreading of a dot or color mixing is suppressed. The main-curing irradiator 14 is provided further on the downstream side from the pre-curing irradiator 13 provided on the most downstream side on the feeding route. The main-curing irradiator 14 irradiates the printing medium 100, on which the discharge of the UV ink and the pre-curing are performed, with a cumulative intensity of ultraviolet light which is greater than that of the pre-curing irradiators 13. The UV ink landing on the printing medium 100 is hereby completely cured and is fixed on the printing medium 100.

In addition, for the pre-curing irradiator 13 and the main-curing irradiator 14, a light emitting diode (LED) lamp, a high-pressure mercury lamp, or the like, which performs irradiation with the ultraviolet, can be used.

Figure 2:
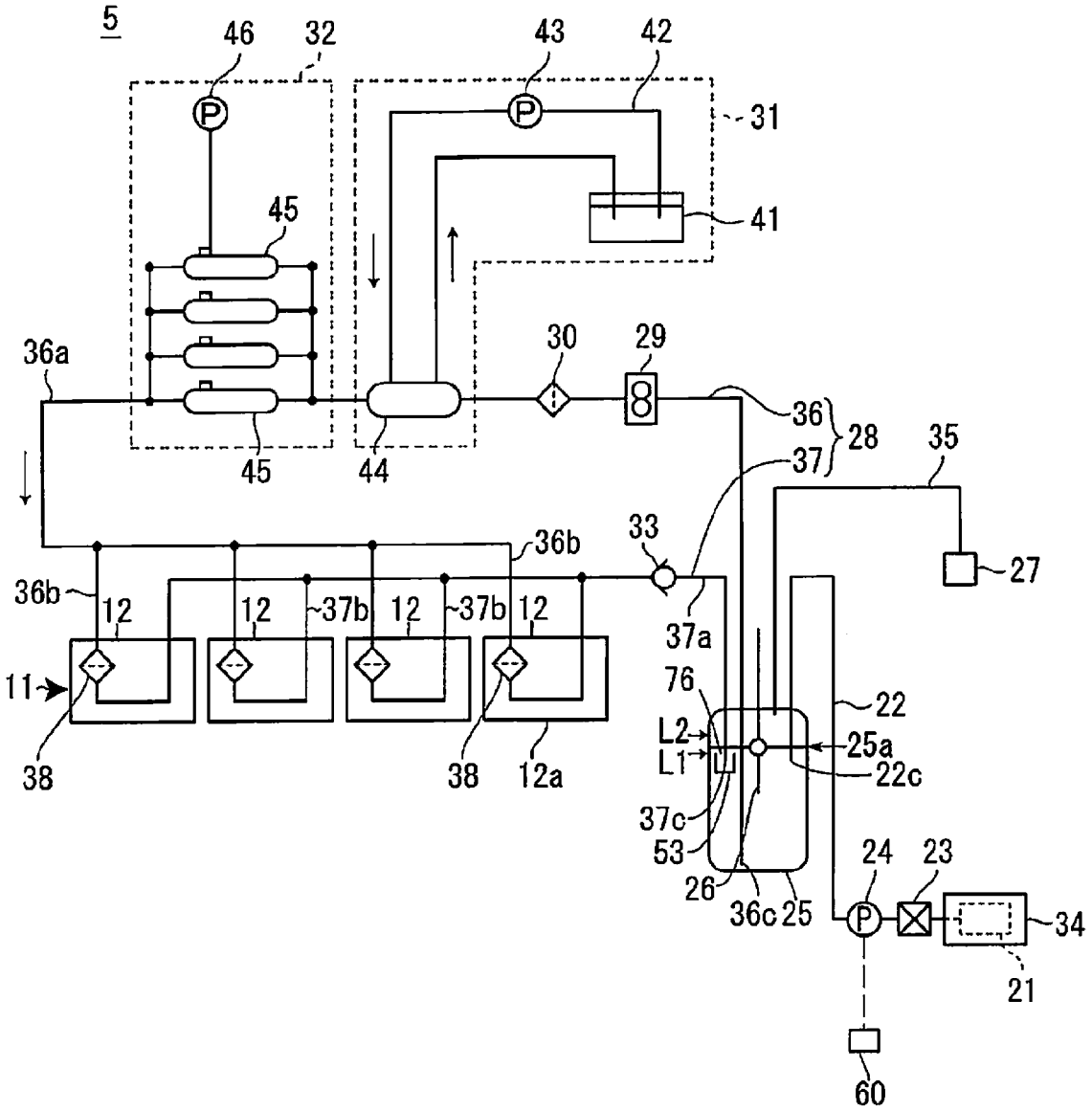
FIG. 2 is a piping system diagram illustrating an ink supply unit included in the printing apparatus illustrated in FIG. 1.

The ink supply unit 5 will be described with reference to FIG. 2. The ink supply unit 5 includes an ink cartridge 21, a supply flow path 22, a supply on-off valve 23, a supply pump 24, a sub-tank 25, a level sensor 26, a pressure regulating unit 27, an ink circulation path 28, a forward-path filter 30, a heating unit 31, a de-airing unit 32, a check valve 33, a receptacle 53, and a control unit 60.

The UV ink is contained in the ink cartridge 21. The ink cartridge 21 is mounted on a holder 34. The upstream-side end of the supply flow path 22 is inserted into the ink cartridge 21 mounted on the holder 34 and the downstream-side end (hereinafter, referred to as a "supply-path downstream-side end 22*c*") of the supply flow path 22 is inserted into the sub-tank 25. The supply-path downstream-side end 22*c* is positioned below a first level L1 to be described below. The supply on-off valve 23 and the supply pump 24 are provided in the supply flow path 22 in this order from the upstream side. The supply on-off valve 23 opens and closes the supply flow path 22. For example, as the supply on-off valve 23, a solenoid-controlled valve can be used. The supply pump 24 sends the UV ink contained in the ink cartridge 21 to the sub-tank 25 through the supply flow path 22. The supply pump 24 is controlled by the control unit 60.

The sub-tank 25 temporarily stores the UV ink sent from the ink cartridge 21. The sub-tank 25 is open-ended. The level sensor 26 detects whether or not the level (hereinafter, referred to as a "tank level 25*a*") of the UV ink in the sub-tank 25 is equal to or higher than a first level L1 and detects whether or not the level is higher than the first level L1 and is equal to or higher than a second level L2. Here, the first level L1 is a level at which back pressure of the UV ink inside the ink discharge head 12 becomes optimal. That is, due to a height difference of a nozzle surface 12*a* of the ink discharge head 12 and the first level L1, a head back pressure, with which no bubbles infiltrate into the inside of the ink discharge head 12 from the nozzle and no UV ink leak from the nozzle of the ink discharge head 12, is applied to the UV ink inside the ink discharge head 12. In addition, the first level L1 is set to a height position of an opening 76 of the receptacle 53 to be described below. In comparison, the second level L2 is positioned at a distance of 5 mm above the first level L1.

When the level sensor 26 detects that the tank level 25*a* is lower than the first level L1, the control unit 60 operates the supply pump 24. The sub-tank 25 is hereby refilled with the UV ink from the ink cartridge 21. When the level sensor 26 detects that the tank level 25*a* is equal to or higher than the second level L2, the control unit 60 stops the supply pump 24. The supply of the UV ink to the sub-tank 25 from the ink cartridge 21 is hereby stopped. In this manner, the control unit 60 controls the supply pump 24 such that the tank level 25*a* is positioned between the first level L1 and the second level L2. As a result, the tank level 25*a* is controlled to be positioned between the height position of the opening 76 of the receptacle 53 and a position at a distance of 5 mm above the height position of the opening 76. In addition, the tank level 25*a* is controlled to be positioned above the height position of the supply-path downstream-side end 22*c*. Further, the height position of the opening 76 of the receptacle 53 is referred to as a position at the lower end of the height position in a portion which defines the opening 76 on the wall surface of the receptacle 53.

The pressure regulating unit 27 supplies air into the sub-tank 25 or emits air in the sub-tank 25 through an air flow path 35, and thereby the inside of the sub-tank 25 is pressurized or depressurized. The pressure regulating unit 27 pressurizes the sub-tank 25 during initial filling of the ink circulation path 28 with the UV ink, cleaning of the ink discharge head 12, or the like.

The ink circulation path 28 is a flow path of the UV ink which returns from the sub-tank 25 through the ink discharge head 12 to the sub-tank 25. The ink circulation path 28 includes a forward circulation path 36 and a backward circulation path 37.

The UV ink, which is supplied to the ink discharge head 12 from the sub-tank 25, flows through the forward circulation path 36. The forward circulation path 36 includes a forward-path-side inter-path 36*a*, and a plurality of forward-path-side diverged paths 36*b* which diverge from the forward-path-side inter-path 36*a*. The upstream-side end (hereinafter, referred to as a "forward-path upstream-side end 36*c*") of the forward-path-side inter-path 36*a* is inserted into the sub-tank 25. The forward-path-side inter-path 36*a* extends to the vicinity of the bottom of the sub-tank 25 such that substantially the entire amount of the UV ink in the sub-tank 25 can be removed as liquid waste through the forward-path-side inter-path 36*a*. That is, the forward-path upstream-side end 36*c* is positioned below the supply-path downstream-side end 22*c* or a backward-path downstream-side end 37*c*. On the forward-path-side inter-path 36*a*, a circulation pump 29, the forward-path filter 30, the heating unit 31, and the de-airing unit 32, are provided in this order from the upstream side. Further, one forward-path-side diverged path 36*b* is provided with respect to each ink discharge head 12. The downstream-side end of the forward-path-side diverged path 36*b* is connected to the ink discharge head 12.

The UV ink, which returns to the sub-tank 25 from the ink discharge head 12, flows through the backward circulation path 37. In other words, the UV ink which is not discharged from the ink discharge head 12, of the UV ink supplied to the ink discharge head 12 through the forward circulation path 36 from the sub-tank 25, returns to the sub-tank 25 through the backward circulation path 37. The backward circulation path 37 includes a plurality of backward-path-side diverged paths 37*b* and a backward-path-side inter-path 37*a* to which the plurality of backward-path-side diverged paths 37*b* joins on the downstream side. A backward-path-side diverged path 37*b* is provided with respect to each ink discharge head 12. The upstream-side end of the backward-path-side diverged path 37*b* is connected to the ink discharge head 12. The downstream-side end (backward-path downstream-side end 37*c*) of the backward-path-side inter-path 37*a* is inserted into the sub-tank 25. The backward-path downstream-side end 37*c* is positioned below the first level L1. The receptacle 53 is attached to the backward-path downstream-side end 37*c*. The check valve 33 is provided in the backward-path-side inter-path 37*a*.

The circulation pump 29 sends the UV ink stored in the sub-tank 25 toward the ink discharge head 12 side. Further, as the circulation pump 29, a gear pump can be appropriately used since the gear pump can suppress pulsation and has temporally small flow fluctuation.

The forward-path filter 30 filters the UV ink flowing through the forward circulation path 36, and thereby removes foreign matter in the UV ink. Foreign matter includes, for example, dust mixed when the upstream-side end of the supply flow path 22 is inserted into the ink cartridge 21, a polymer of the UV ink due to frictional heat generated in the circulation pump 29 which is a gear pump, or the like. Further, a head filter 38 that filters the UV ink is also provided on the inflow side of the ink discharge head 12; however, the forward-path filter 30 is provided in the forward circulation path 36, and thereby it is possible to sustain the head filter 38 which is difficult to replace.

The heating unit 31 heats the UV ink flowing through the ink circulation path 28 to a predetermined temperature (for example, 35° C. to 40° C.). The predetermined temperature is a temperature at which the UV ink which is supplied to the ink discharge head 12 has a viscosity suitable for discharge from the ink discharge head 12. At the time of start-up of the printing apparatus 1, the UV ink having a temperature lower than the predetermined temperature is heated to the predetermined temperature by the heating unit 31, and then the printing apparatus 1 starts a printing operation.

The heating unit 31 includes a hot-water tank 41 having a heater and a thermometer, a hot-water circulating path 42, a hot-water pump 43, and a heat exchanger 44. The hot-water tank 41 stores hot water having a temperature adjusted within a predetermined temperature range. The hot-water circulating path 42 is a flow path through which hot water returns to the hot-water tank 41 through the heat exchanger 44 from the hot-water tank 41. The hot-water pump 43 circulates the hot water in the hot-water circulating path 42. The heat exchanger 44 performs heat exchange between the hot water flowing through the hot-water circulating path 42 and the UV ink flowing through the ink circulation path 28.

The de-airing unit 32 expels air form the UV ink flowing through the ink circulation path 28. The UV ink containing bubbles is hereby prevented from being supplied to the ink discharge head 12. The de-airing unit 32 includes a de-airing module 45 and a negative pressure pump 46. The de-airing module 45 includes a plurality of hollow fiber membranes. The negative pressure pump 46 depressurizes the outer side of the hollow fiber membrane. Air is hereby expelled from the UV ink flowing in the hollow fiber membrane.

The check valve 33 allows the UV ink to flow to the sub-tank 25 side in the backward circulation path 37 and blocks the UV ink from reversely flowing to the ink discharge head 12 side. The foreign matter which is contained in the UV ink reversely flowing through the backward circulation path 37 is prevented from entering the ink discharge head 12 by the check valve 33. Further, in order to replace a part of the ink discharge head 12, in a case where the backward circulation path 37 is detached from the sub-tank 25, or the like, the UV ink reversely flows to the ink discharge head 12 side in the backward circulation path 37.

Figure 3A:
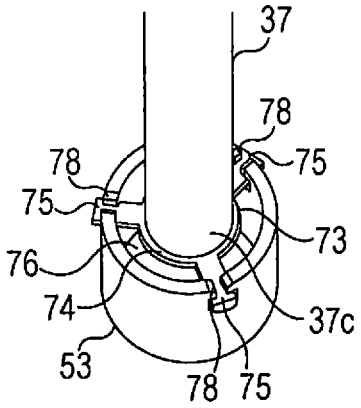
FIGS. 3A to 3C are views illustrating a receptacle included in the ink supply unit illustrated in FIG. 2.
Figure 3B:
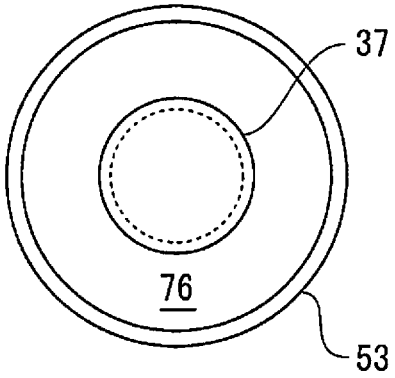
Figure 3C:
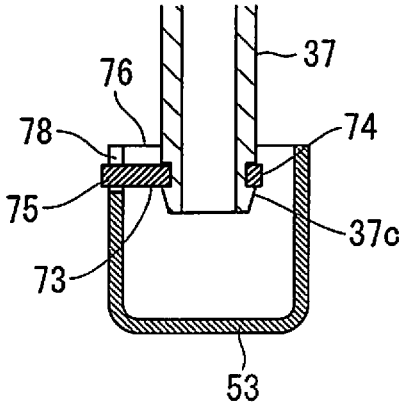

The receptacle 53 and the attachment member 73 will be described with reference to FIGS. 3A to 3C. The receptacle 53 is attached to the backward-path downstream-side end 37*c* through an attachment member 73. The attachment member 73 includes a fitting portion 74 and three engagement portions 75. The fitting portion 74 is formed to have an annular shape. The fitting portion 74 fits in a circular groove formed around the end of the backward-path downstream-side end 37*c*. The three engagement portions 75 are provided with respect to the fitting portion 74 substantially at an equal interval in a circumferential direction and protrude in the radial direction of the fitting portion 74. The distal end of the engagement portion 75 engages with a notch 78 to be described below.

The receptacle 53 is formed to have substantially a cylindrical shape with a bottom. That is, the receptacle 53 has an opening 76 opened upward. The three notches 78 are provided substantially at an equal interval on the upper end portion of the receptacle 53. The distal end of the engagement portion 75 engages with the notch 78. The backward-path downstream-side end 37*c* is inserted into the inside of the receptacle 53 through the opening 76 of the receptacle 53 but the forward-path upstream-side end 36*c* is not inserted into the inside of the receptacle. In addition, as described above, the receptacle 53 is provided such that the height position of the opening 76 is the same level as the first level L1 (refer to FIG. 2).

Figure 4A:
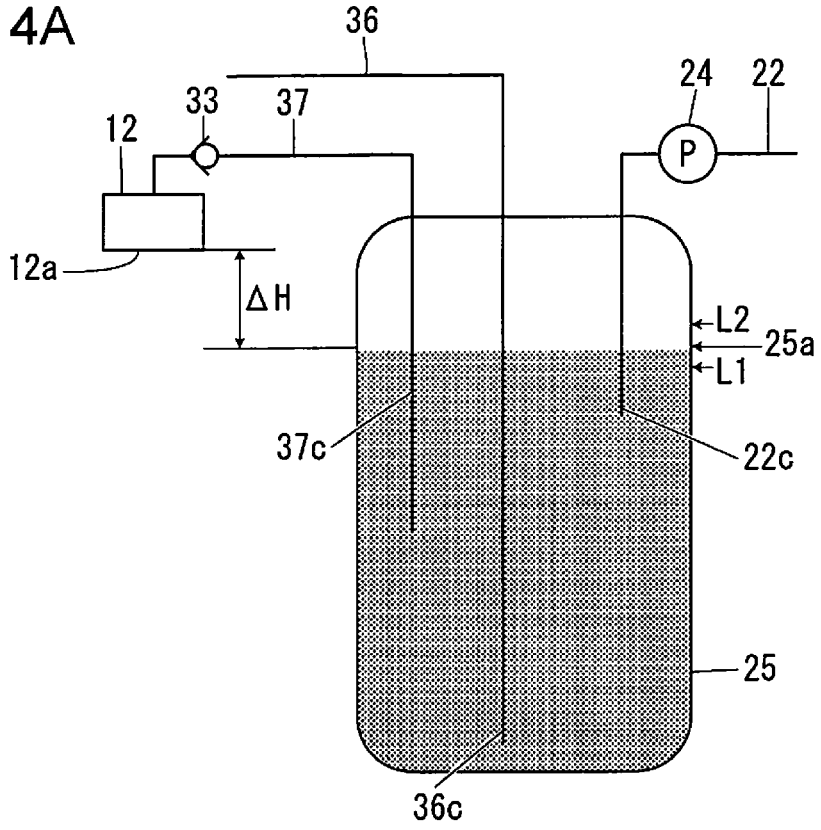
FIGS. 4A and 4B are views illustrating a peripheral configuration of a sub-tank of the printing apparatus according to a modification example of the invention.
Figure 4B:
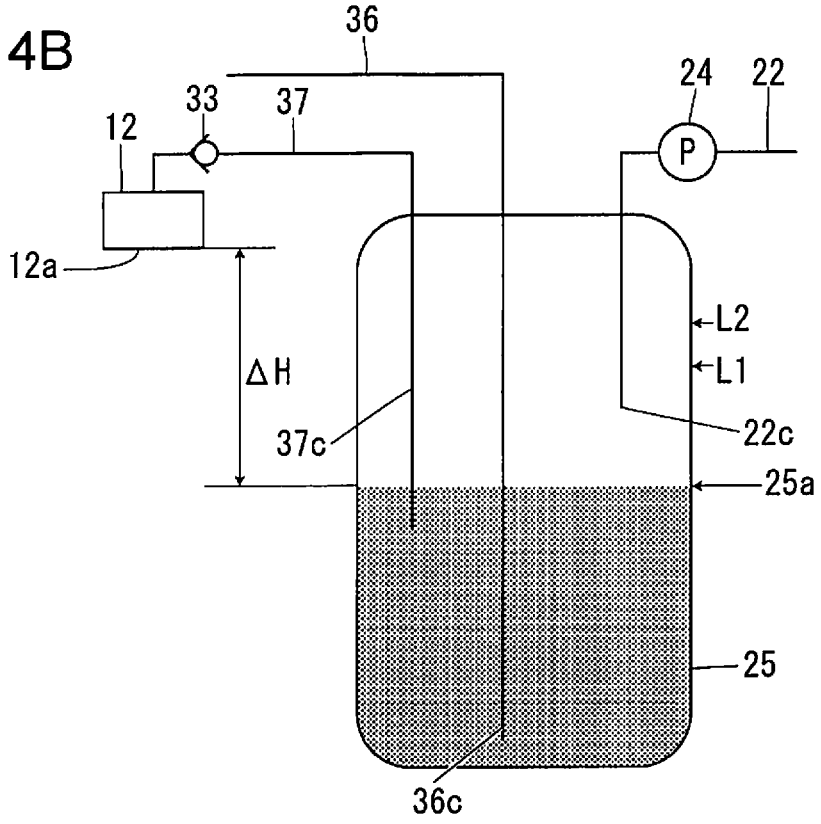

Functions of the receptacle 53 in the printing apparatus 1 will be described with reference to FIGS. 4A to 5B. FIGS. 4A and 4B illustrate a peripheral configuration of the sub-tank 25 in a case where the receptacle 53 is not provided inside the sub-tank 25, which is different from the printing apparatus 1 of the present embodiment. In this case, a height difference between the nozzle surface 12*a* of the ink discharge head 12 and the tank level 25*a* becomes a water head difference ΔH which has an influence on a head back pressure. As described above, the tank level 25*a* is maintained between the first level L1 and the second level L2 (refer to FIG. 4A). However, the UV ink is not properly supplied to the sub-tank 25 due to an abnormality such as deterioration or malfunction in the supply pump 24, and thus the tank level 25*a* becomes lower than the first level L1 in some cases (refer to FIG. 4B). In this case, the height difference between the nozzle surface 12*a* of the ink discharge head 12 and the tank level 25*a*, increases and the water head difference ΔH has a relatively large negative pressure which has an influence on the head back pressure. As a result, air infiltrates into the inside of the ink discharge head 12 from the nozzle.

Figure 5A:
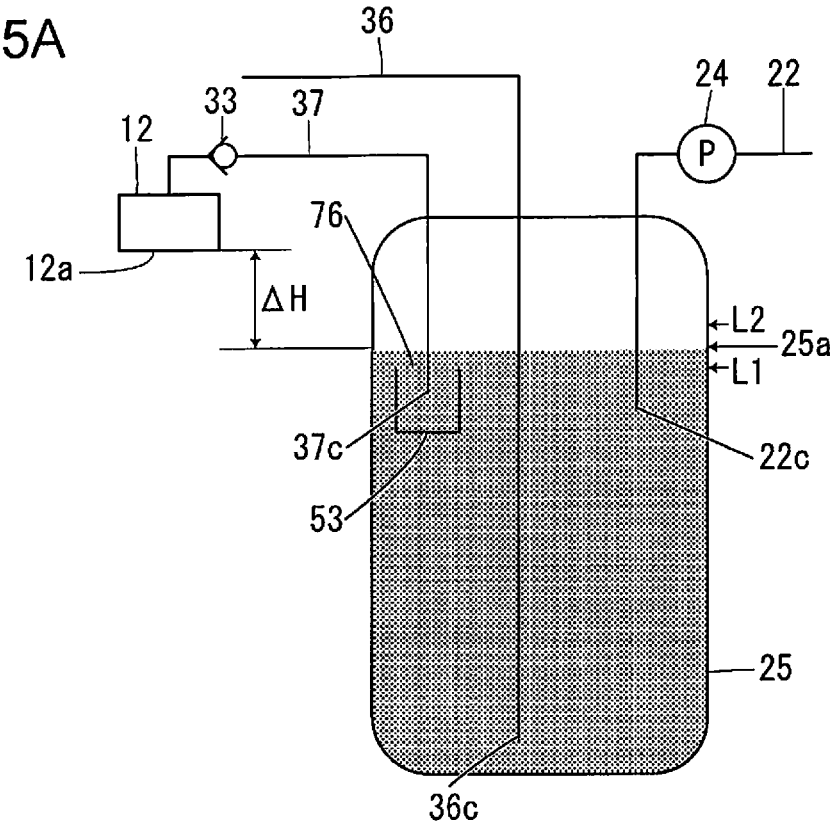
FIGS. 5A and 5B are views illustrating a peripheral configuration of a sub-tank of the printing apparatus in FIG. 1.
Figure 5B:
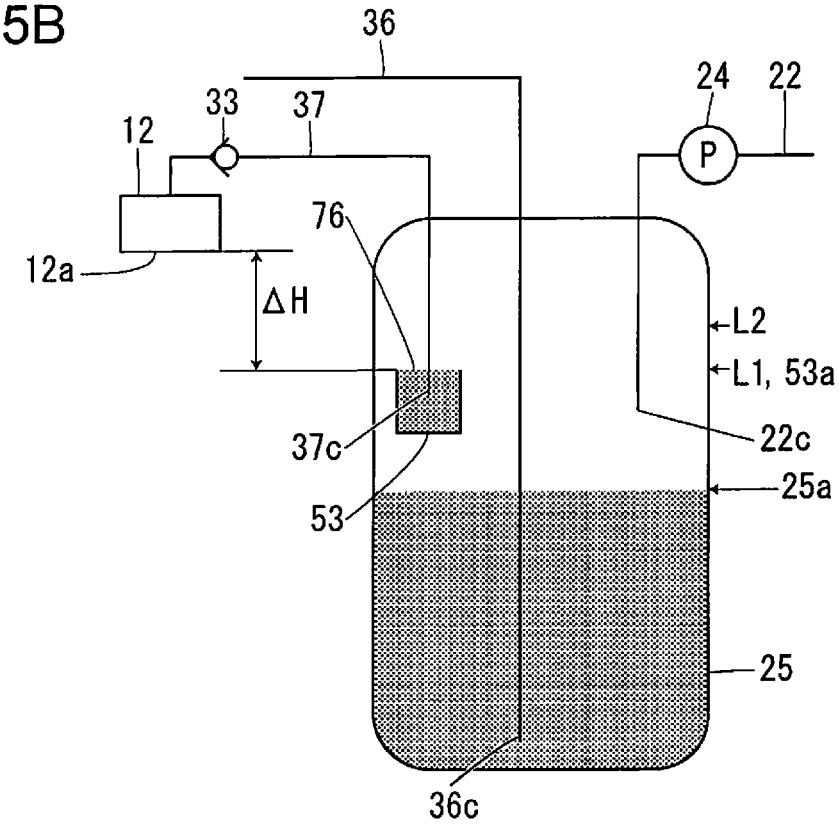

FIGS. 5A and 5B illustrate a peripheral configuration of the sub-tank 25, which includes a receptacle 53, of the printing apparatus 1 of the present embodiment. In this case, as described above, the backward-path downstream-side end 37*c* is positioned below the opening 76 inside the receptacle 53 and the forward-path upstream-side end 36*c* is positioned below the receptacle 53 inside the sub-tank 25. Therefore, in a case where the tank level 25*a* is lower than the height position of the opening 76, the UV ink in the receptacle 53 is not reduced but the level (hereinafter, referred to as a receptacle level 53*a*) of the UV ink in the receptacle 53 maintains the same level as the height position of the opening 76, that is, the first level L1 (refer to FIG. 5B). In a case where the tank level 25*a* becomes lower than the height position of the opening 76, the height difference between the nozzle surface 12*a* of the ink discharge head 12 and the opening 76 of the receptacle 53 hereby becomes the water head difference ΔH which has an influence on the head back pressure. Accordingly, even in a case where thus the UV ink is not properly supplied to the sub-tank 25 due to an abnormality in the supply pump 24, and the tank level 25*a* becomes lower than the first level L1, that is, the height position of the opening 76, the water head difference ΔH which has an influence on the head back pressure is maintained as a constant value (height difference between the nozzle surface 12*a* and the opening 76), and thus the head back pressure is not fluctuated. Further, the control unit 60 stops the printing apparatus 1 after a predetermined continuous duration of the state in which the tank level 25*a* becomes lower than the first level L1. In this manner, it is possible to prevent the tank level 25*a* from becoming lower than the height position of the forward-path upstream-side end 36*c* and to prevent air from entering from the forward-path upstream-side end 36*c*, due to printing continuation in the state in which the UV ink is not properly supplied to the sub-tank 25.

In addition, in a case where the supply pump 24 normally operates, as described above, the tank level 25*a* is controlled to be between the first level L1 and the second level L2, that is, between the height position of the opening 76 and the position which is 5 mm above the height position (refer to FIG. 5A). In this case, in a case where the tank revel 25*a* is positioned at the second level L2, the water head difference ΔH which has an influence on the head back pressure becomes the lowest; however, even in this case, the water head difference is a value which is smaller only by 5 mm than the height difference between the nozzle surface 12*a* and the opening 76. As described above, in a case where the tank level 25*a* becomes lower than the height position of the opening 76 due to the abnormality in the supply pump 24, this value is changed only by 5 mm. Accordingly, according to the printing apparatus 1 of the present embodiment, it is possible to reduce a difference between the head back pressure obtained in the case where the supply pump 24 normally operates and the head back pressure obtained in the case where the supply pump 24 has an abnormality. In addition, while the supply pump 24 normally operates, a fluctuation range of the tank level 25*a* is only 5 mm. Therefore, while the supply pump 24 normally operates, it is possible to reduce a fluctuation range of the head back pressure.

As above, according to the printing apparatus 1 of the present embodiment, it is possible to control the fluctuation of the head back pressure.

According to the printing apparatus 1 of the present embodiment, the tank level 25*a* is controlled to be positioned below the height position of the supply-path downstream-side end 22*c*. The UV ink hereby flows to the sub-tank 25 from the supply flow path 22 at a position below the level of the UV ink in the sub-tank 25. Therefore, when the UV ink flows into the sub-tank 25, generation of air in the UV ink in the sub-tank 25 is suppressed.

According to the printing apparatus 1 of the present embodiment, the height difference between the nozzle surface 12*a* and the opening 76 (first level L1) is the height difference causing the head back pressure, with which no air infiltrates into the inside of the ink discharge head 12 from the nozzle and no UV ink leaks from the nozzle of the ink discharge head 12, to be applied to the UV ink in the ink discharge head 12. Infiltration of the air from the nozzle into the inside of the ink discharge head 12 is hereby suppressed and leakage of the UV ink from the nozzle of the ink discharge head 12 is suppressed.

Further, the sub-tank 25 is an example of an "ink storage unit". The ink cartridge 21 is an example of an "ink container". The supply pump 24 is an example of a "liquid sending unit".

The invention is not limited to the embodiment described above, and it is needless to say that various configurations within a scope without departing from the scope of the invention as defined in the claims can be employed. For example, the embodiment can be modified in accordance with the following aspects.

The control unit 60 may control the supply pump 24 such that the tank level 25*a* is positioned not only between the first level L1 and the second level L2, but also between the height position of the opening 76 and a position in a range of equal to or less than 5 mm above the height position of the opening 76. For example, the control unit 60 may control the supply pump 24 such that the tank level 25*a* is maintained at a predetermined position in a range of equal to or less than 5 mm above the height position of the opening 76. It is possible to hereby have no fluctuation range in the head back pressure while the supply pump 24 normally operates. In addition, the control unit 60 may control the supply pump 24 such that the tank level 25*a* is maintained at the height position of the opening 76. It is possible to hereby have the optimal value of the head back pressure because it is possible to eliminate the difference between the head back pressure obtained in the case where the supply pump 24 normally operates and the head back pressure obtained in the case where the supply pump 24 has an abnormality. In addition, the second level L2 is not limited to a position which is 5 mm above the first level L1. The second level L2 may be appropriately set such that the head back pressure is within a permissible range in which no air is infiltrated into the inside of the ink discharge head from the nozzle and no ink leaks from the nozzle of the ink discharge head. In addition, in the embodiment described above, the check valve 33 is provided in the backward circulation path 37; however, it is possible to omit the check valve 33. In this case, it is preferable that the first level L1 is set to a height equal to or higher than the height position of the opening 76 of the receptacle 53 such that the UV ink does not reversely flow in the ink circulation path 28 in a case where the circulation of the UV ink is stopped in the ink circulation path 28.

Figure 6:
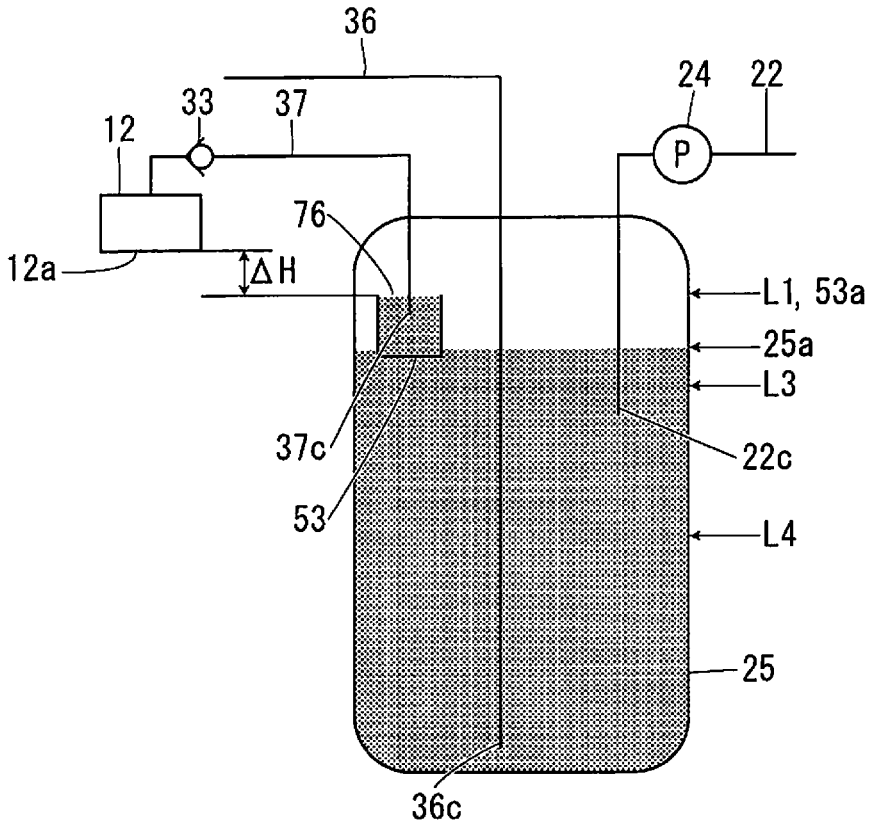
FIG. 6 is a view illustrating a peripheral configuration of a sub-tank of a printing apparatus according to another embodiment of the invention.

As illustrated in FIG. 6, the control unit 60 may control the supply pump 24 such that the tank level 25*a* becomes lower than the first level L1 which is the height position of the opening 76. In this case, even in a case where the supply pump 24 normally operates, the height difference between the nozzle surface 12*a* and the opening 76 becomes the water head difference ΔH which has an influence on the head back pressure. Accordingly, it is possible to hereby eliminate the difference between the head back pressure obtained in a case where the supply pump 24 normally operate and the head back pressure obtained in a case where the supply pump 24 has an abnormality. Further, the tank level 25*a* is less than the receptacle level 53*a*; however, even in a case where the circulation of UV ink is stopped in the ink circulation path 28 when an operation of the printing apparatus 1 is stopped or the like, the check valve 33 is provided in the backward circulation path 37. Therefore, the UV ink is prevented from reversely flowing in the ink circulation path 28. Further, as described in the embodiment above, the check valve 33 may be provided in the backward-path-side inter-path 37*a* or may be provided for each backward-path-side diverged path 37*b*. Further, the control unit 60 stops the printing apparatus 1 after a predetermined continuous duration of the state in which the tank level 25*a* becomes lower than the third level L3. At this time, instead of the third level L3, the fourth level L4 may be set as a determination criterion. In this manner, it is possible to prevent the tank level 25*a* from becoming lower than the height position of the forward-path upstream-side end 36*c* and to prevent air from entering from the forward-path upstream-side end 36*c*, due to printing continuation in the state in which the UV ink is not properly supplied to the sub-tank 25. Here, the third level L3 is a predetermined position below the first level L1 and below the supply-path downstream-side end 22*c*. In addition, the fourth level L4 is a predetermined position below the supply-path downstream-side end 22*c* and below the forward-path upstream-side end 36*c*.

As long as the receptacle 53 has the opening 76 opened upward, the shape of the receptacle 53 is not particularly limited and, for example, may be substantially an inverted cone.

Figure 7A:
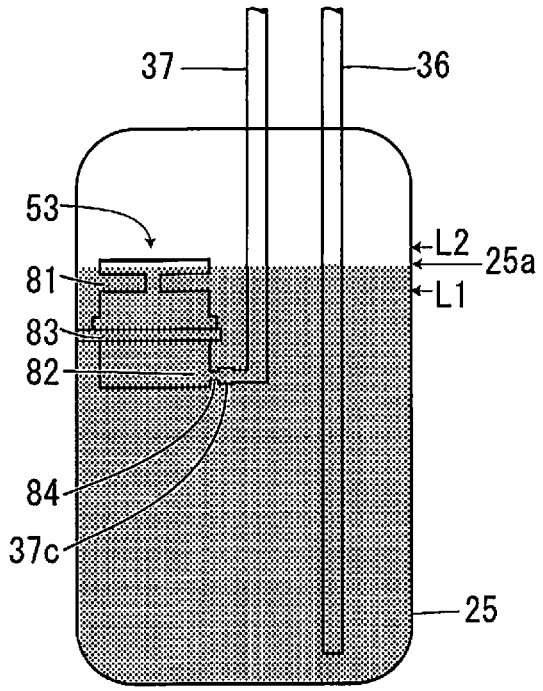
FIGS. 7A and 7B are views illustrating a modification example of the receptacle.
Figure 7B:
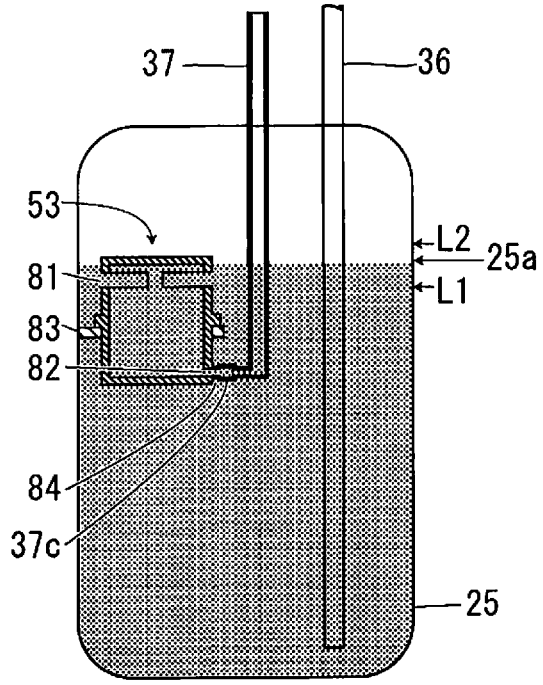

In addition, the receptacle 53 may not have the opening 76 opened upward. The shape of the receptacle 53 can be a shape illustrated in FIGS. 7A and 7B. In other words, the receptacle 53 is formed to be substantially cylindrical with the bottom and the ceiling and includes a first opening 81 provided on the side surface of the cylinder and a second opening 82 provided on the side surface of the cylinder below the first opening 81. According to the present embodiment, the backward-path downstream-side end 37*c* is connected to the second opening 82 and the receptacle 53 is supported by a ring-shaped receptacle support 83 provided on the wall surface of the sub-tank 25 such that the lower end of the first opening is positioned at the first level L1. The supply pump 24 is controlled such that the tank level 25*a* is positioned between the first level L1 and the second level L2. As illustrated in FIGS. 7A and 7B, connection between the backward-path downstream-side end 37*c* and the second opening 82 may be performed by fitting and connecting the backward-path downstream-side end 37*c* and a joint 84 provided on the side surface of the cylinder. This case is also included in a case where "the end portion of the backward circulation path on the ink storage unit side is positioned below the opening inside the receptacle".

The ink used in the printing apparatus 1 is not limited to the UV ink and, for example, water-based ink, oil-based ink, solvent ink or sublimation ink may be used.

The entire disclosure of Japanese Patent Application No. 2015-068978, filed Mar. 30, 2015 is expressly incorporated by reference herein.

What is claimed is:

1. A printing apparatus comprising:

an ink discharge head for discharging ink;

an ink storage unit for storing the ink;

a liquid sending unit for sending the ink to the ink storage unit from an ink container containing the ink;

an ink circulation path having a forward circulation path through which the ink, which is to be supplied to the ink discharge head from the ink storage unit, can flow, and a backward circulation path through which the ink, which is to return to the ink storage unit from the ink discharge head, can flow; and a receptacle that has an opening opened upward and is provided inside the ink storage unit, wherein an end portion of the backward circulation path on the ink storage unit side is positioned below the opening inside the receptacle and an end portion of the forward circulation path on the ink storage unit side is positioned below the receptacle inside the ink storage unit.

2. The printing apparatus according to claim 1, further comprising:

a control unit for controlling the liquid sending unit such that the level of the ink in the ink storage unit is positioned in a range equal to or higher than the a first level which is a position equal to the height position of the opening and equal to or lower than the a second level which is a position higher than the height position of the opening by a predetermined length.

3. The printing apparatus according to claim 2, wherein the control unit is arranged to control the liquid sending unit such that the level of the ink in the ink storage unit is equal to the first level.

4. The printing apparatus according to claim 2, further comprising:

a supply flow path through which the ink, which is to be supplied to the ink storage unit from the ink container, can flow, wherein the control unit is arranged to control the liquid sending unit such that the level of the ink in the ink storage unit is positioned above the height position of the end portion of the supply flow path on the ink storage unit side.

5. The printing apparatus according to claim 1, further comprising:

a control unit for controlling the liquid sending unit such that the level of the ink in the ink storage unit becomes lower than a first level which is a position equal to the height position of the opening; and a check valve that is provided in the backward circulation path for blocking the ink from reversely flowing to the ink discharge head in the backward circulation path.

6. The printing apparatus according to claim 1, wherein a height difference between the nozzle surface of the ink discharge head and the opening of the receptacle is a height difference causing a back pressure, with which no air infiltrates into the inside of the ink discharge head from a nozzle and no ink leaks from the nozzle of the ink discharge head, to be applied to the ink in the ink discharge head.

7. The printing apparatus according to claim 1, further comprising:

an attachment member through which the receptacle is attached to the end portion of the backward circulation path on the ink storage unit side.

8. A printing apparatus comprising:

an ink discharge head for discharging ink;

an ink storage unit for storing the ink;

a liquid sending unit that sending the ink to the ink storage unit from an ink container containing the ink;

an ink circulation path having a forward circulation path through which the ink, which is to be supplied to the ink discharge head from the ink storage unit, can flow, and a backward circulation path through which the ink, which is to return to the ink storage unit from the ink discharge head, can flow; and a receptacle that has a first opening and a second opening positioned below the first opening, and that is provided in the ink storage unit, wherein an end portion of the backward circulation path on the ink storage unit side is connected to the second opening and an end portion of the forward circulation path on the ink storage unit side is positioned below the receptacle inside the ink storage unit.

9. The printing apparatus according to claim 8, wherein the second opening is provided on the side surface of the receptacle, wherein a joint communicating with the second opening is provided on the side surface of the receptacle, and wherein the end portion of the backward circulation path on the ink storage unit side is fitted to the joint.

* * * * *